United States Patent [19]

Buchner

[11] Patent Number: 4,627,221

[45] Date of Patent: Dec. 9, 1986

[54] METHOD FOR PRODUCING STERILE PACKAGES

[75] Inventor: Norbert Buchner, Winnenden, Fed. Rep. of Germany

[73] Assignee: Robert Bosch GmbH, Stuttgart, Fed. Rep. of Germany

[21] Appl. No.: 765,992

[22] Filed: Aug. 15, 1985

[30] Foreign Application Priority Data

Oct. 25, 1984 [DE] Fed. Rep. of Germany ..... 3439020

[51] Int. Cl.[4] ..... B65B 55/02

[52] U.S. Cl. ..... 53/425; 53/141; 53/167

[58] Field of Search ..... 53/167, 411, 425, 426, 53/452, 453, 459, 567, 141

[56] References Cited

U.S. PATENT DOCUMENTS

| | | | |
|---|---|---|---|
| 3,335,540 | 8/1967 | Reil et al. | 53/426 |
| 3,594,978 | 7/1971 | Spitznagel | 53/567 |
| 3,753,332 | 8/1973 | Membrino | 53/567 |
| 4,223,512 | 9/1980 | Buchner | 53/425 |
| 4,270,965 | 6/1981 | Torterotot et al. | 156/244.11 |
| 4,287,702 | 9/1981 | Corbic | 53/425 |
| 4,317,321 | 3/1982 | Torterotot et al. | 53/426 |
| 4,409,775 | 10/1983 | Brody | 53/266 R X |

FOREIGN PATENT DOCUMENTS

| | | | |
|---|---|---|---|
| 3019503 | 11/1981 | Fed. Rep. of Germany . | |
| 1251602 | 12/1960 | France | 53/567 |

*Primary Examiner*—John Sipos
*Assistant Examiner*—Steven P. Weihrouch
*Attorney, Agent, or Firm*—Edwin E. Greigg

[57] ABSTRACT

Sterile packages are produced which have a shaped depression and a closure sheet sealed onto this depression. In order to furnish sterile inner surfaces for the packages, two tubes of packaging material each of which have a sterile inner surface are slit lengthwise and opened out into flat strips in order to form the depressions and the closure strip. Depressions are produced in one strip, which is underlaid with a reinforcing strip; thereafter the depressions are filled and sealed with the closure strip, which has one layer comprising the strip made from the other tube and another layer from another strip. The sterile surfaces of the strips are arranged so that they face one another.

6 Claims, 3 Drawing Figures

METHOD FOR PRODUCING STERILE PACKAGES

BACKGROUND OF THE INVENTION

The invention is based on a method for producing sterile packages. In order to avoid using chemical sterilizing agents in producing containers for sterile packaging of perishable foods, a method is already known from German Offenlegungsschrift 27 44 506, in which a multi-layered strip composed of a strip of packaging material and a protective strip covering the inside thereof is prepared for the container and another for the lid; the two sides of the two layers resting on one another are kept sterile. In a sterile enclosure in which cup-shaped containers are shaped and filled, the two layers are peeled apart. One strip of packaging material is then shaped into containers, and after the containers are filled the covering strip is then sealed onto the containers. The protective strips, after being peeled off, are wound up again and put through a recycling process. For one example, it was proposed that the protective strip be used as a covering foil for the containers.

This known method necessitates some precautions which are difficult to adhere to. For instance, the protective strip must be joined to the packaging material strip under sterile conditions. Also, the bond should be arranged such that the protective strip can be easily peeled from the strip of packaging material. On the other hand, if the protective strip is to be used as a covering foil, it must be able to form a good seal with the packaging material strip. This means there are limitations in terms of the attainable tightness of the sealed seam. Also, the protective strip must not be too thin, to assure that the peeling process works properly. The amount of material required is accordingly relatively large. Since the individual layers must be joined to one another under sterile conditions, preferably immediately after their manufacture, it is hardly possible to provide for printing of the protective strip, and so it can hardly be considered for use as a covering foil. Also, it is very expensive to manufacture the strips, because this requires a very special starting material, which is shaped into a strip under controlled, sterile conditions.

A further disadvantage is that the packager of the product loses the opportunity to oversee securing the sterility of the packaged product at several points. Specifically, the strips can become contaminated during manufacture, printing, cutting, transporting, and storage. In particular, an unintentional delamination at the cut side edges can occur during these various operations, causing a local contamination. For this reason, in practice the protective strip that is to be peeled off is slit at a distance of approximately 1 cm from the edge, so that the vulnerable outer zone is not sent to the processing station or stations. As a result, however, there is still further waste.

A method for producing sterile packages in two parts is also known from German Offenlegungsschrift 30 19 503, in which a tube of packaging material having a sterile inside surface is furnished, folded flat, and as it enters the sterile enclosure it is cut into two strips at its two folded edges. Depressions are formed in one of these strips and the depressions are filled, and then the other strip is sealed onto the first, that is, the strip having the depressions. In this process, the wall of the tube may be quite thin, because the sterility in the interior of the tube can readily be maintained. In order to lend the containers a certain rigidity, the strip having the depressions may have an underlay of a separate deformable strip, which is then deformed together with the one strip of the tube. This method has the advantage over the first method described above in that a substantially less expensive, standard material can be used as the starting material, that the sterility in the interior of the tube can be attained substantially more easily than is the case with flat material, and that a loss in sterility during storage and transporting is much less likely, because the tube is closed on the side. Furthermore, underlaying the strip having the depressions with an additional deformable strip is also advantageous if, in the case where printing might be done, it is not the strip having the depressions itself, but rather the additional strip that will be printed upon. The disadvantage of this packaging manufacturing method known from German Offenlegungsschrift 30 19 503, however, is that after the tube has been separated into two strips, the strip intended for sealing must be transported over a relatively long distance, bridging over the stations for forming and filling the depressions, and care must be taken that the sterile inner surface not be infected from the direction of the non-sterile outer surface.

OBJECT AND SUMMARY OF THE INVENTION

The method for producing sterile packages according to the present invention has the advantage over the prior art that each of the two tubes need not be slit open until immediately prior to being further processed, thereby avoiding transportation problems. Also, tubes having different sealing or fusing properties can be used for the strip having the depressions and for the closure strip, so as to be able to vary the force required for pulling the sealing strip off the edge of a depression in order to open the package.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
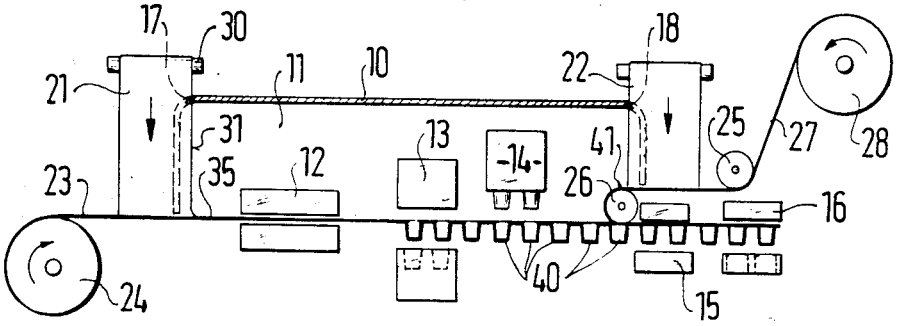
FIG. 1 is a longitudinal section taken through an apparatus for shaping, filling and closing beaker containers.
Figure 2:
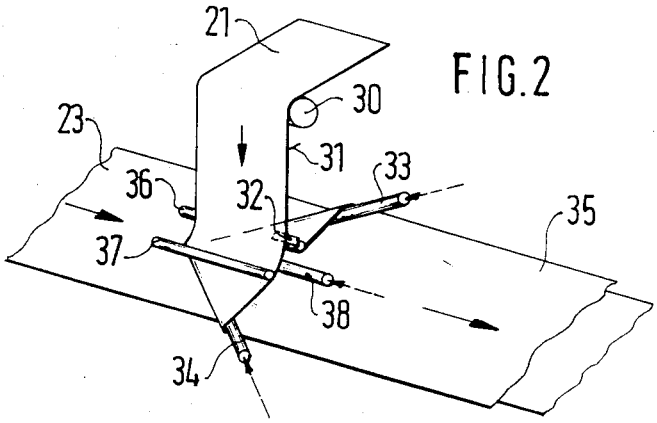
FIGS. 2 and 3 are perspective views of devices for slitting and spreading apart a tube, which are part of the apparatus according to FIG. 1.

In a sterile enclosure 11 surrounded by a housing 10 and filled with a sterile atmosphere, a heating station 12, a shaping station 13 and a filling station 14 are arranged adjacent to one another. Outside the housing 10, next to the filling station 14, a sealing station 15 and a stamping station 16 are provided. In each of its two end walls, the housing 10, which is open at the bottom, has a narrow gap 17, 18, respectively, into which a respective flat-folded tube 21, 22 is introduced. The underside of the housing 10 that is open on the bottom is closed off by a strip 23 that is drawn from a supply roll 24. A strip 27 is also unrolled from a supply roll 28 and introduced via deflecting rollers 25, 26 into the sterile enclosure 11.

The strip 23 and the tube 21 are made of a deformable packaging material, preferably a thermoformable plastic. The strip 27 and the tube 22 are made of a packaging material that is particularly amenable to sealing. The two tubes 21 and 22, which are drawn from supply rolls that are not shown, have a sterile inside surface.

The first tube 21, from which together with the strip 23 containers are formed, is guided via a deflecting roller 30 from the top toward the middle of the strip 23, and a folded edge 31 extends through the gap 17 into the sterile enclosure 11 of the housing 10. Not far above the plane of the strip 23, the tube 21 is slit open longitudinally by a slitting knife 32 at its folded edge 31 located in the sterile enclosure 11. Its two layers joined to the other folded edge are unfolded, by two shaping members 33, 34 disposed at angles to one another, into a flat strip 35, which comes to rest upon the strip 23. Two guide rods 36, 37 feed the superimposed layers of the tube 21 underneath the slitting knife 32. In order to avoid infection or contamination of the inner surface of the strip 35 from the outside, sterile air or a sterile gas is blown between the stillsuperimposed layers, through the two hollow shaping members 33 and 34 and also through a nozzle 38 disposed beneath the slitting knife 32; this air or gas emerges at the cut edges, and the slight overpressure generates a flow toward the outside. The sterile air that has been introduced also keeps the sterile enclosure 11 at a slight overpressure, so that sterile air can flow out through the gaps 17, 18 and through the slits arising between the strip 23 and the underside of the housing 10 and thereby prevent infection or contamination of the sterile enclosure 11.

With the sterile inside of the strip 35 formed from the tube 21 facing upward, the two superimposed strips 23 and 35 are moved through the individual processing stations 12–16 by a conveyor apparatus, not shown. In the heating station 12, they are heated to a temperature suitable for thermoforming, any by the use of heat contact plates they are bonded together as well. In the shaping station 13, depressions 40 are formed in the double-layered strip 23, 35 by drawing. The strip 35 comes to rest in the interior of the depressions and with its sterile surface forms the inside of a depression 40. In the filling station 14, the depressions are filled with portions of a sterile product. Prior to the sealing station 15, a closure strip 41 is placed upon the double strip 23, 35 containing the depressions 40, and in the sealing station 15 this strip 41 is sealed to the edge of the depressions 40. The cohering, sealed depressions are then cut into individual packages in the stamping station 16.

The closure strip 41, like the strip 23, 35 having the depressions, is double-layered. Its two layers comprise the strip 27 and a strip placed upon it, which is formed by slitting open the tube 22 delivered through the gap 18 at the right-hand end of the housing 10. In the same manner as the first tube 21, the tube 22 is introduced into the housing 10, where it is slit and its wall is unfolded flat on the strip 27, its sterile inside surface facing upward, away from the strip 27. By deflection of the thus-formed, double-layered closure strip 41 about the deflecting roller 26, the sterile surface of this strip 41 comes to rest atop the likewise sterile surface of the strip 23, 35 having the depressions. The two layers of the strip 41 are joined to one another in the sealing station 15 at the same time as this strip 41 is sealed to the strip 23, 35 having the depressions.

The strip 27 which lends strength and/or tightness to the closure strip 41 may be of aluminum, paper, cardboard, plastic, or a combination of such materials, and it may have a heat-sealable coating which enables it to be glued to the strip made from the tube 22. The strip 23 and the strip 35 made from the tube 21 can also be of a cold-formable material to enable shaping of the containers by deep drawing without using the heating device 12.

It should also be noted that if it is possible to dispense with a certain rigidity of the containers, they can also be made merely from the tubes 21 and 22, in which case the strips 23 and 27 are omitted.

Figure 3:
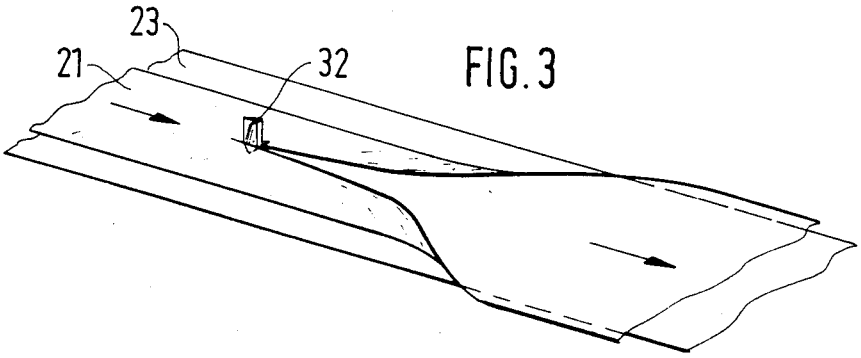

As shown in FIG. 3, the tubes 21 and 22 can also be slit and unfolded in one strip, by making a dividing cut in the middle of one layer, between the two folded edges, and opening out the two upper halves of the upper wall laterally toward the outside. Preferably, this process takes place after the tube 21 has been placed centrally on top of the strip 23.

Finally, it should also be noted that for producing a strip having sterile surfaces on both sides, one tube can be slitted and used in such a way that its originally sterile inner surface faces to the outside. it is also possible then to introduce a reinforcing strip into the interior and to seal or fuse the two edges produced by the slitting process to one another.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for producing packages containing a sterile product in seriatim in a sterile atmosphere comprising the steps of:

introducing a first deformable packaging material in the form of a tubular homogeneous strip into said atmosphere, said tubular strip having a sterile inner face portion, opening said tubular strip by severing longitudinally and exposing said inner face portion in said atmosphere, forming depressions in the opened strip whereby the inside of said depressions is constituted by said sterile inner face portion, filling said depressions with a sterile product, introducing a second packaging material in the form of a homogeneous tubular strip having a sterile inner face portion into said atmosphere, opening said second tubular strip by severing longitudinally and exposing said inner face portion in said atmosphere, causing said second strip to form a running length of strip material with a sterile face portion, bringing in contact the sterile face portion of said second strip with the inner face portion surrounding the filled depressions of said first strip, and sealing said contacted surfaces together to form sealed packages having a sterile interior and severing the packages.

2. A method as defined by claim 1, comprising the further steps of:

traversing said tubular homogeneous strip perpendicular to a traveling support material, severing said tubular homogenous strip along a folded portion and, causing said severed tubular homogeneous strip to be moved at a speed commensurate with said traveling support material.

3. A method as defined by claim 1, comprising the further steps of:

providing said tubular homogeneous strip material of plural layers and, severing only one of said layers.

4. A method as defined in claim 2, comprising the further step of:

combining said traveling support material with said tubular homogeneous strip at said deforming station.

5. A method as defined in claim 1, comprising the further step of:

providing a traveling support material beneath said running length of strip material.

6. A method as defined in claim 5, comprising the further step of:

forming opposed depressions in said traveling support material and said running length of strip material and combining said traveling support material with said running length of strip material.

* * * * *